US007392987B1

(12) United States Patent
Lowrance

(10) Patent No.: US 7,392,987 B1
(45) Date of Patent: Jul. 1, 2008

(54) GAME SIMULATING THE CATCHING OF FISH BY PLUG CASTING

(75) Inventor: Arlen J. Lowrance, Tulsa, OK (US)

(73) Assignee: Velma K. Lowrance, Tulsa, OK (US)

( * ) Notice: Subject to any disclaimer, the term of this patent is extended or adjusted under 35 U.S.C. 154(b) by 0 days.

(21) Appl. No.: 11/788,271

(22) Filed: Apr. 19, 2007

(51) Int. Cl.
*A63F 9/30* (2006.01)

(52) U.S. Cl. ..... 273/343; 273/348

(58) Field of Classification Search ..... 273/317, 273/331, 333, 343, 348, 391, 393, 407, 140, 273/440, 447
See application file for complete search history.

(56) References Cited

U.S. PATENT DOCUMENTS 2,320,145 A * 5/1943 La Due ..... 273/350
2,343,002 A * 2/1944 Colaluca ..... 273/393
2,393,726 A * 1/1946 Yejoff ..... 273/140
2,482,057 A * 9/1949 Fincke ..... 273/393
2,511,430 A * 6/1950 Colaluca ..... 273/393
2,598,487 A * 5/1952 Anechiarico ..... 446/132
2,611,617 A * 9/1952 Strohm ..... 273/140
2,703,469 A * 3/1955 Raizen ..... 446/153
3,463,494 A * 8/1969 Stroh ..... 273/348.3
3,620,532 A * 11/1971 Graf et al. ..... 273/447
3,788,641 A * 1/1974 Lemelson ..... 273/448
4,976,439 A * 12/1990 Kraemer ..... 273/350
5,094,461 A * 3/1992 Lowrance ..... 273/343
5,180,170 A * 1/1993 Lowrance ..... 273/343
5,310,193 A * 5/1994 Lowrance ..... 273/393
5,367,503 A * 11/1994 Lowrance ..... 368/10
5,657,995 A * 8/1997 Howard ..... 273/333
6,726,207 B1 * 4/2004 Jacobus ..... 273/343

* cited by examiner

*Primary Examiner*—Raleigh W. Chiu

(57) ABSTRACT

A fishing apparatus comprising a flat, essentially vertical game board, a fish support mounted behind the game board, one or more flat, relatively thin fish-shaped members releasably mounted on the fish support, each fish-shaped member having a tapered mouth at on end thereof and a circular snare opening connecting to the mouth through a first slot, a casting line, a plug adapted to be connected to the end of the casting line so that the plug and line can be cast over the fish-shaped members, each plug being made of resilient material and being provided with a nose piece adjacent to the connection of the line to the plug, the nose piece being receivable in the snare opening, the game board having a second slot therein which is in alignment with the first vertical slot in the fish-shaped member, the second vertical slot in the game board being associated with a pair of doors which are mounted on hinge axes for swinging movement when a fish-shaped member is pulled against the doors, whereby, when the plug is pulled into the circular snare opening and the line is pulled thereafter, the fish-shaped member will spring out through the hinged doors in a manner simulating the catching of fish in actual water.

5 Claims, 10 Drawing Sheets

GAME SIMULATING THE CATCHING OF FISH BY PLUG CASTING

This application discloses an invention which is an improvement over the invention set forth in my prior U.S. Pat. No. 5,094,461, issued Mar. 10, 1992, on "Fishing Game Apparatus."

BACKGROUND OF THE INVENTION

1. Field of the Invention

The present invention relates to an apparatus or device which can be used to simulate fishing. More particularly, the apparatus of the present invention includes one or more artificial fish which are temporarily retained on a support and which are removed from the support using an operation which is similar to the action of fishing by casting a plug.

2. Prior Art

There are numerous games or devices wherein "fish" are involved as game pieces or tokens. However, the prior art does not disclose a fishing device or apparatus of the type disclosed herein.

SUMMARY OF THE INVENTION

The present invention involves a fishing device or apparatus wherein one or more flat vertical objects resembling fish are arranged in a horizontal row along a support. Each "fish" is provided with one or more circular support openings which are adapted to be removably received on or over a button on a grommet which, in turn, is received in a slot on the fish support. Each fish is also provided with a entrance opening at the upper end of the fish. The lower portion of each entrance opening is provided with a slot which connects with a circular snare opening below the mouth. For the purpose of catching the fish, the would be fisherman, or player, will utilize a casting rod with a winding reel, which form no part of this invention. The end of the line which connects with the fishing rod and the reel, however, will be provided with a plug which cooperates with the circular snare opening immediately below the entrance opening of the fish. The plug is made of resilient material, such as rubber or plastic, and is provided with a nose piece adjacent the connection of the line to the plug. This nose piece is tapered from a diameter of smaller size than the snare opening in the fish to a diameter slightly larger than the diameter in the snare opening. Immediately beyond the larger diameter of the nose piece, the plug is provided with a recess so that when the plug is pulled into the snare opening, the nose piece will squeeze through the opening until the sides of the opening are lodged in the recess. Further pulling on the line will pull the fish off the support and the fish is now "caught".

In order to assist the fisherman in directing his line into the slot and circular snare opening of each fish, the support is located to the rear of an essentially vertical game board or surface which includes at least one vertical slot which is ultimately in alignment with the slot in the fish. In one form of the invention, the game board is provided with a single vertical slot extending between two doors which are mounted for swinging opening movement along vertical hinge axes. The entire game board including the surfaces of the two doors is provided with a plastic film, or "wallpaper" on which scenes from a lake or seaside are depicted to provide reality to the game. The upper edges of the game board are tapered inwardly on opposite sides of the slot so that a fisherman, if he gets his line over the upper end of the game board, can manipulate the line, by sidewise tugging, into the slot. A flexible and adjustable plastic loop is located at the upper end of the game board to provide a space for the fisherman to cast his plug between the loop and the upper end of the game board.

DETAILED DESCRIPTION OF THE PREFERRED EMBODIMENTS

Figure 1:
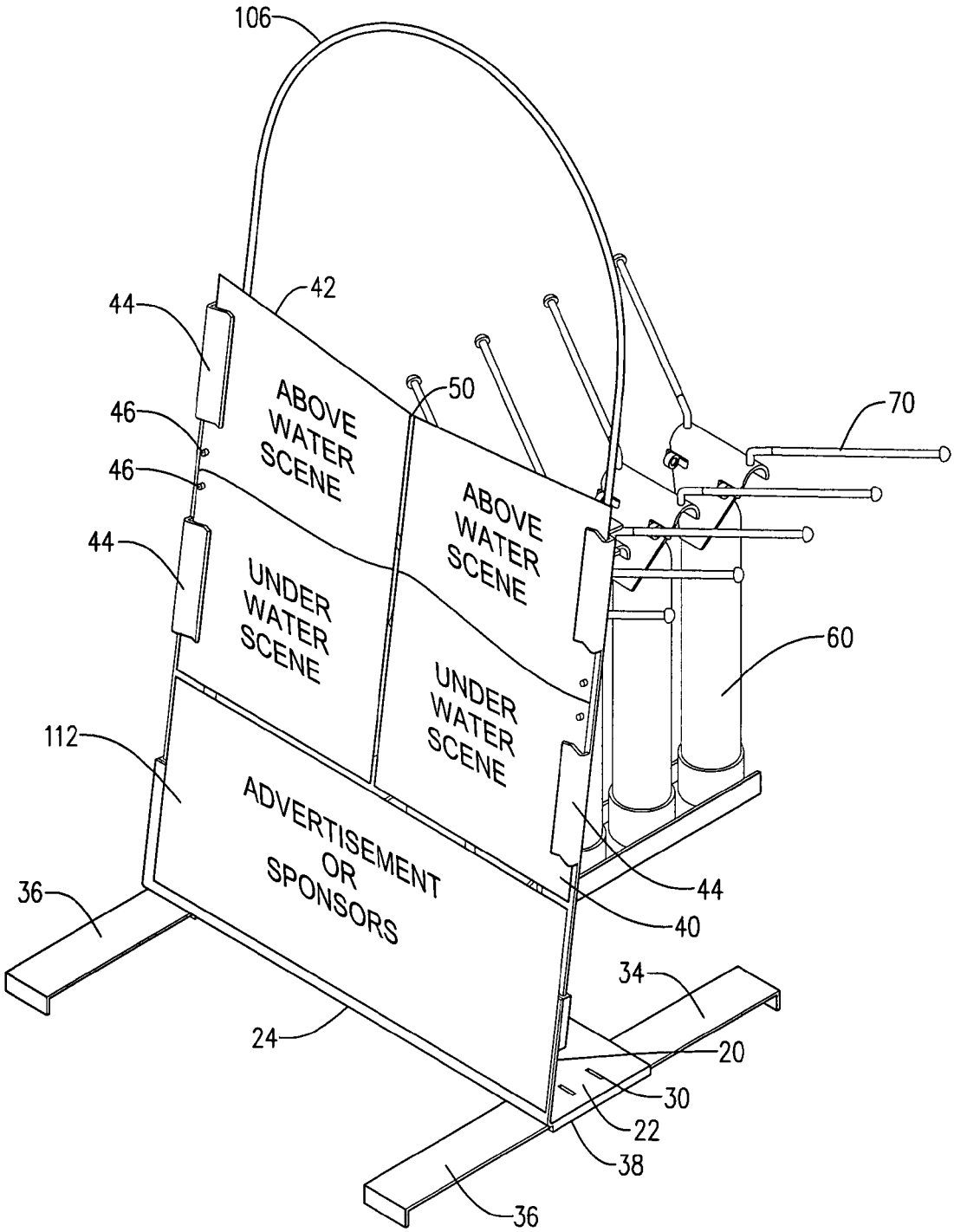
FIG. 1 is a front perspective view, of the present invention, with the back ground graphic being shown as legends on the doors and on the panel beneath the doors.

Referring to the drawings in detail, FIG. 1 shows a relatively flat game surface or board 20 which is disposed at a relatively large angle (preferably 60 degrees or more) with respect to a flat horizontal member 22 which is connected at its front 24 to the bottom of the game board 20. The members 20 and 22 can be formed in a single piece or they can be formed separately and connected together. The game board 20 also includes a pair of vertical supports 26 which are secured to the game board 20 by means of rectangular pockets 28. Each pocket 28 is provided with a slot 30 which cooperates with a ridge 32 on the vertical support 26. Thus, when the vertical support 26 is inserted into the pocket 28 the ridge 32 will engage the slot 30 and "lock" the vertical support 26 in position with respect to the vertical game board 20.

The horizontal member 22 is provided with rearwardly extending horizontal legs 34 and forwardly extending horizontal legs 36. These legs are received at opposite ends of a pocket 38 which is formed at the bottom of the member 22. Each pocket 38 is provided with a pair of slots 30 which cooperate with ridges 32 on the legs 34 and 36 in much the same manner as vertical support 26 cooperates with its pocket 28.

Figure 8:
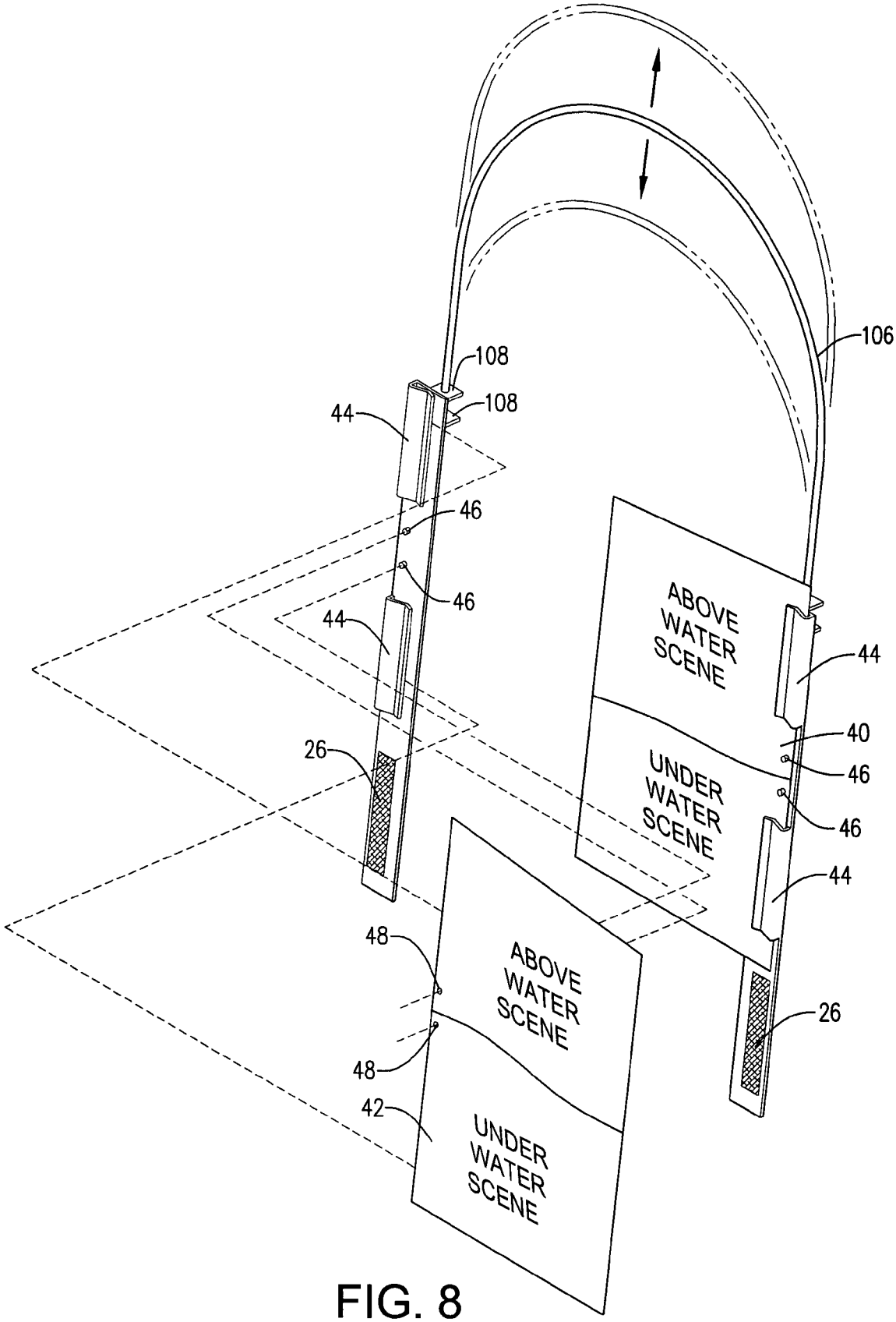
FIG. 8 is a partial front perspective view particularly of the doors associated with the game board.

The game board 20 has associated therewith a pair of doors 40 and 42 which are connected to the vertical supports 26 so as to swing hingedly with respect thereto. That is, the vertical uprights 26 (see now FIG. 8) are provided with clamps 44 at the upper and mid portions of the uprights 26 to engage the upper and lower side edges of the doors 40 and 42. For the purpose of keeping the doors in proper alignment with the vertical members 26, each vertical member 26 is provided with a pair of outwardly projecting pins 46 which are adapted to be received in holes 48 along the sides of the doors 40 and 42.

Figure 2:
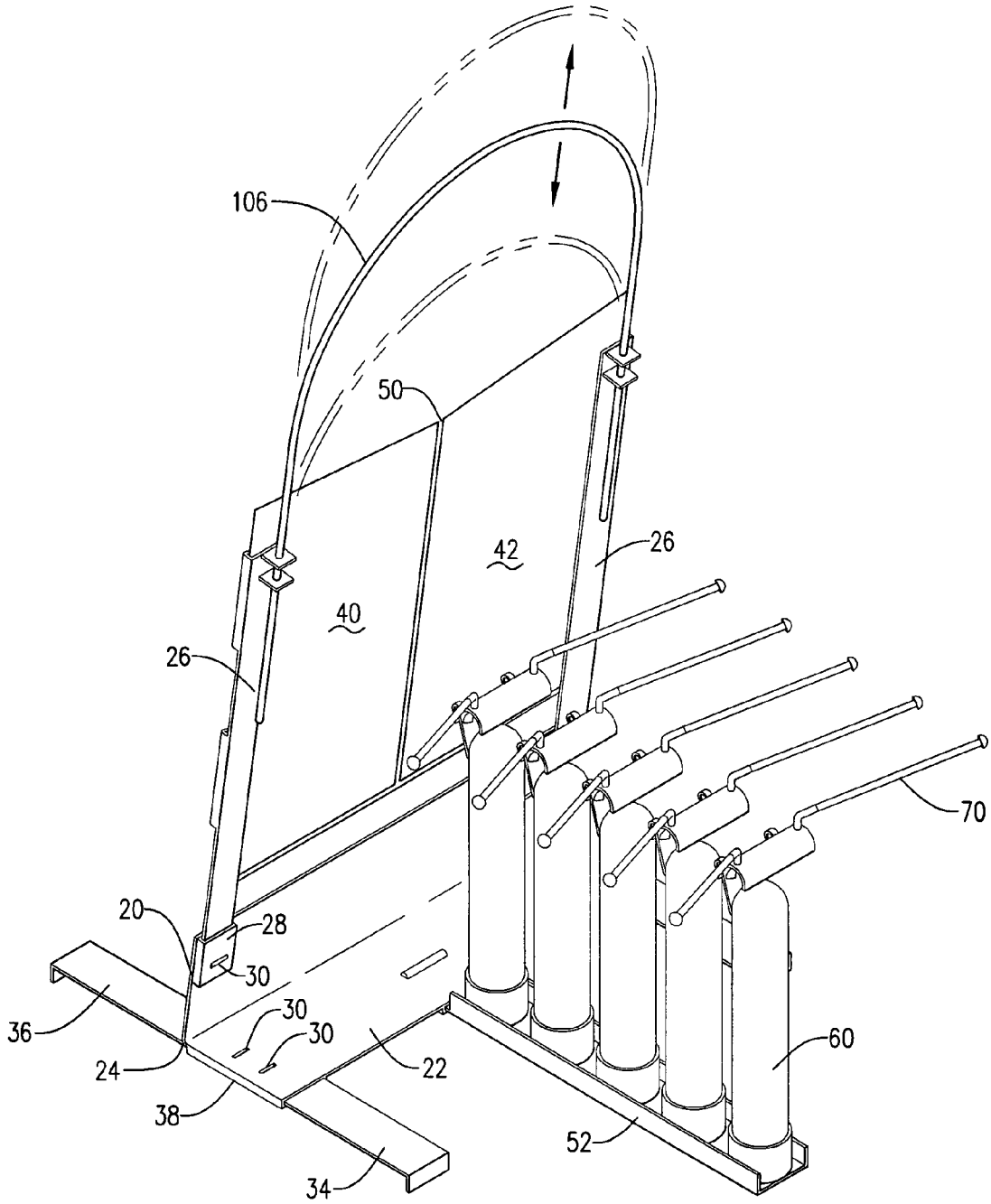
FIG. 2 is a rear perspective view, of the invention shown in FIG. 1.
Figure 3:
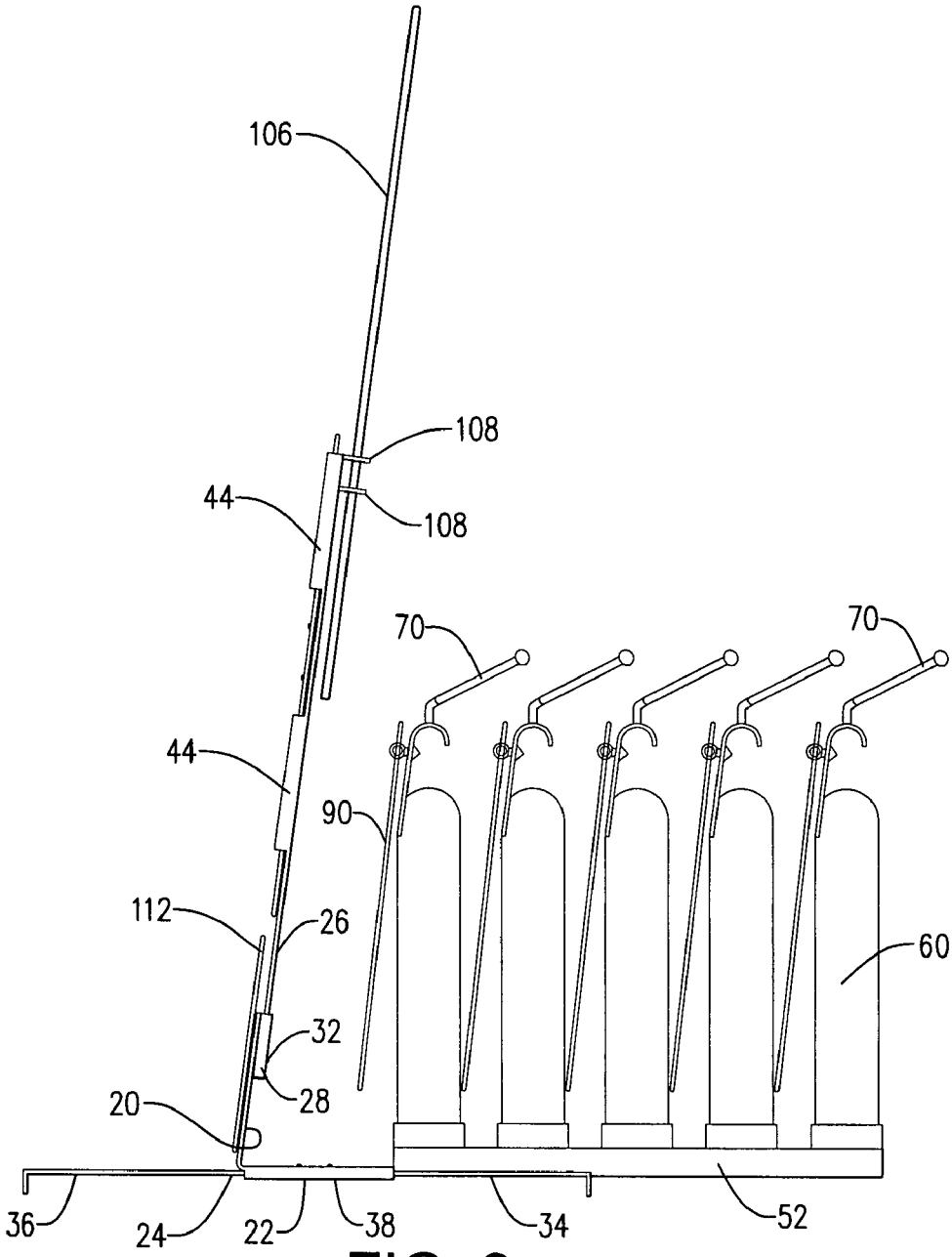
FIG. 3 is a right side elevation taken from FIG. 1.

Turning now to FIGS. 1 and 2, the vertical space between the doors 40 and 42 can be considered as a slot 50 which will be aligned with a slot in the fish as will be later explained. Extending to the rear of the horizontal support 22 is a horizontal tray 52 having a forward projecting tab 54 and vertical sides 56. Spaced along the horizontal tray 52 between the vertical sides 56 are a plurality of circular sockets 58 which are adapted to receive a plurality of vertical tubes 60. The lower end of each vertical tube 60 is provided with a vertical slot 62 which is adapted to be received over a radial member 64 on the inside of the socket 58. The arrangement of the slot 62 and the radial member 64 is such that the lower end of the tube 60 is prevented from turning in the socket 58. The upper end of each tube is provided with an inclined triangular member 66 which is connected to the tube 60 in any convenient manner. Each triangular member 66 is provided with a pair of slots 68 which are adapted to receive a pair of grommets 71 for a purpose which will hereafter appear. The upper end of each triangular plate 66 is also provided with a pair of upwardly and outwardly diverging arms 70 which are provided with rounded buttons 72 at the end thereof to prevent snagging of the line.

Figure 7:
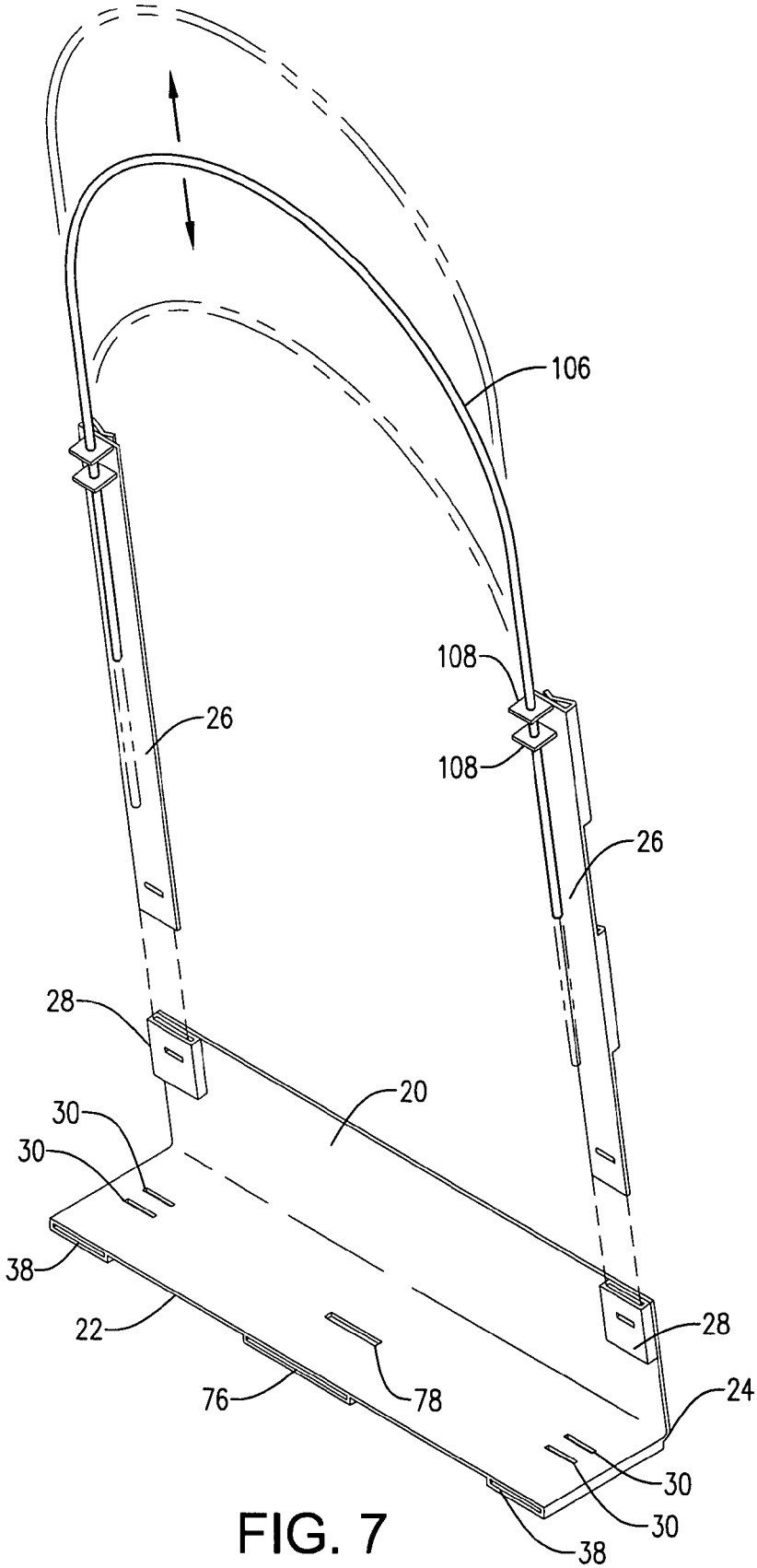
FIG. 7 is a rear perspective view of the game board and its supporting structure.

As best shown in FIG. 7, a pocket 76 is provided midway of the horizontal support 22 essentially equidistant from the pocket 38 but somewhat wider than the pockets 38. The pocket 76 is provided with a slot 78 which is somewhat longer than the slots 30 in the pockets 38. The forward end 54 of the horizontal tray 52 is adapted to be received in the pocket 76 and a ridge 80 thereon is adapted to engage the slot 78 of the pocket 76.

Figure 4:
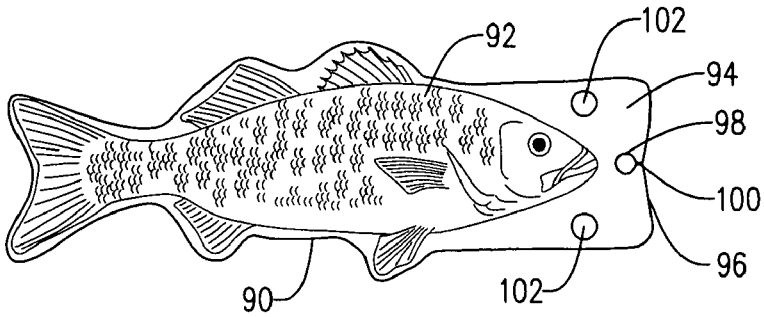
FIG. 4 is a plan view of one of the fishes used in the game of the present invention.
Figure 6:
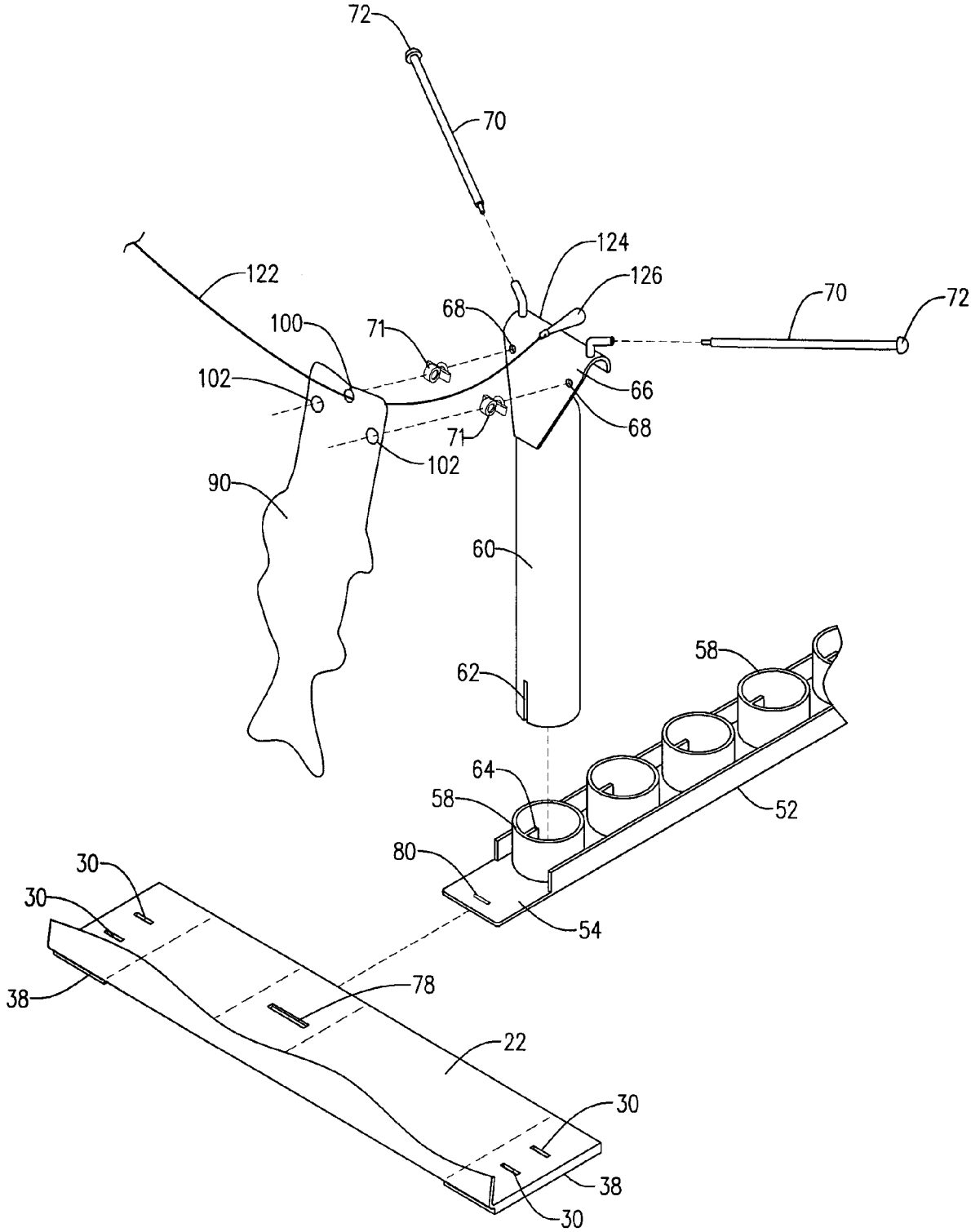
FIG. 6 is a partial exploded view of the sub-assembly for the fish support.

Turning now to FIG. 4, the game objet of the present invention is a fish shaped game piece 90 which has shows a depiction of a fish 92 thereon. however, the forward or right-hand end of the game piece 90 is provided with a projecting portion 94 which includes an inclined entrance opening 96 which leads to a snare opening 98 through a slot 100. The game piece 90 is also provided with a pair of support openings 102 on opposite sides and "below" the snare opening 100 as best shown in FIG. 6 the support openings 102 are adapted to fit over the grommets 71 which are attached to the inclined triangular plate 66. A flexible loop 106 extends above the vertical supports 26 and is attached thereto by means of tabs 108. The tabs are provided with holes through which the loop 106 may be inserted and which provide an adjustability as indicated by the dotted lines in FIG. 7.

Figure 5:
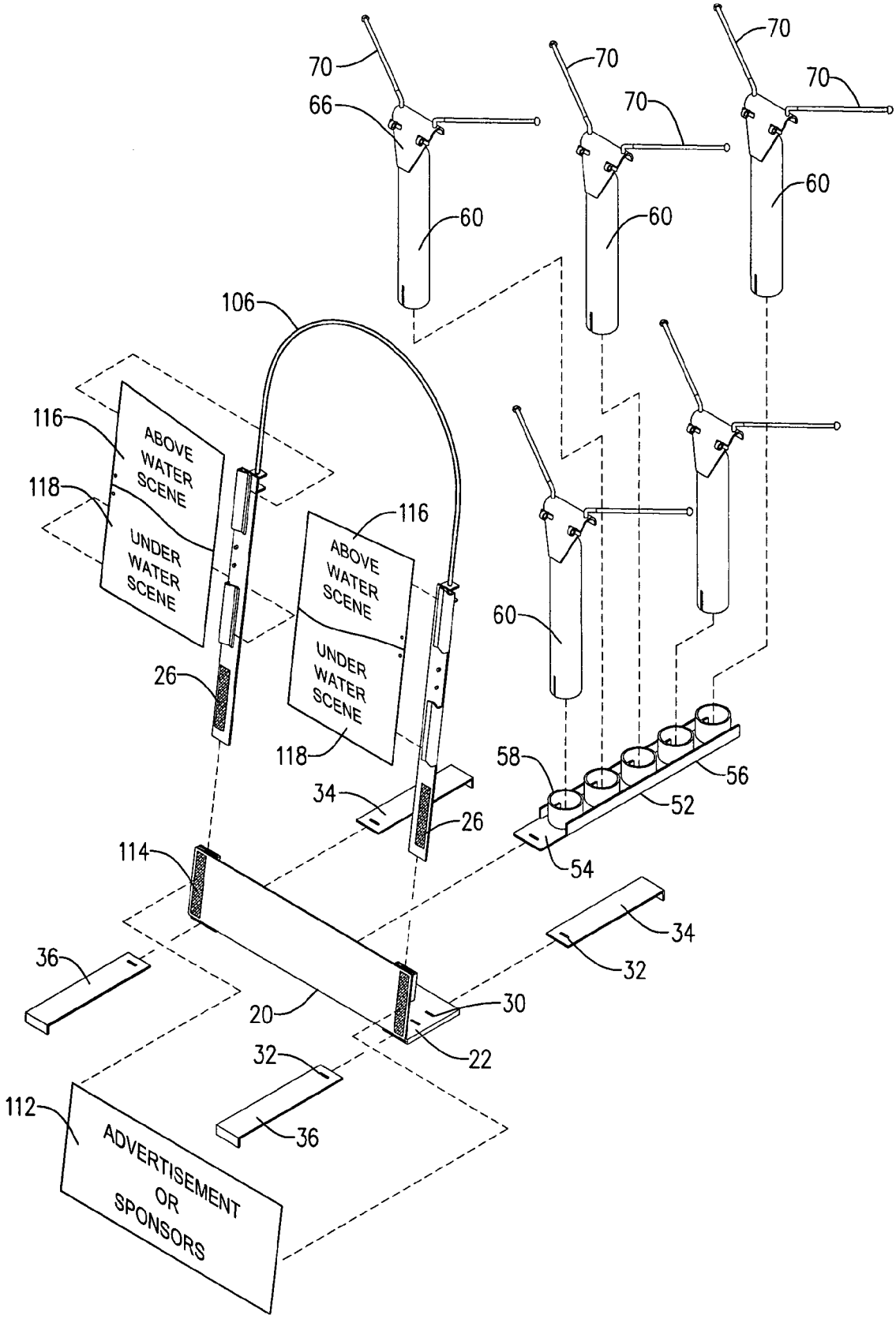
FIG. 5 is an exploded view taken from FIG. 1, showing how the various parts are assembled.

As best shown in FIG. 5, a vertical advertising plate 112 which is designed to have advertising thereon is attached to the vertical plate 20 by means of velcro strips or the like 114.

The doors 40 and 42 are covered with plastic film or sheets 116 and 118, which can sometimes be referred to as "wallpaper." The purpose of the film 116 and 118 is to provide a design thereon which will simulate that appearance of a lake or other fishing location. Preferably, the films 116 depict an above water scene whereas the films 118 depict a scene below the water.

Figure 9:
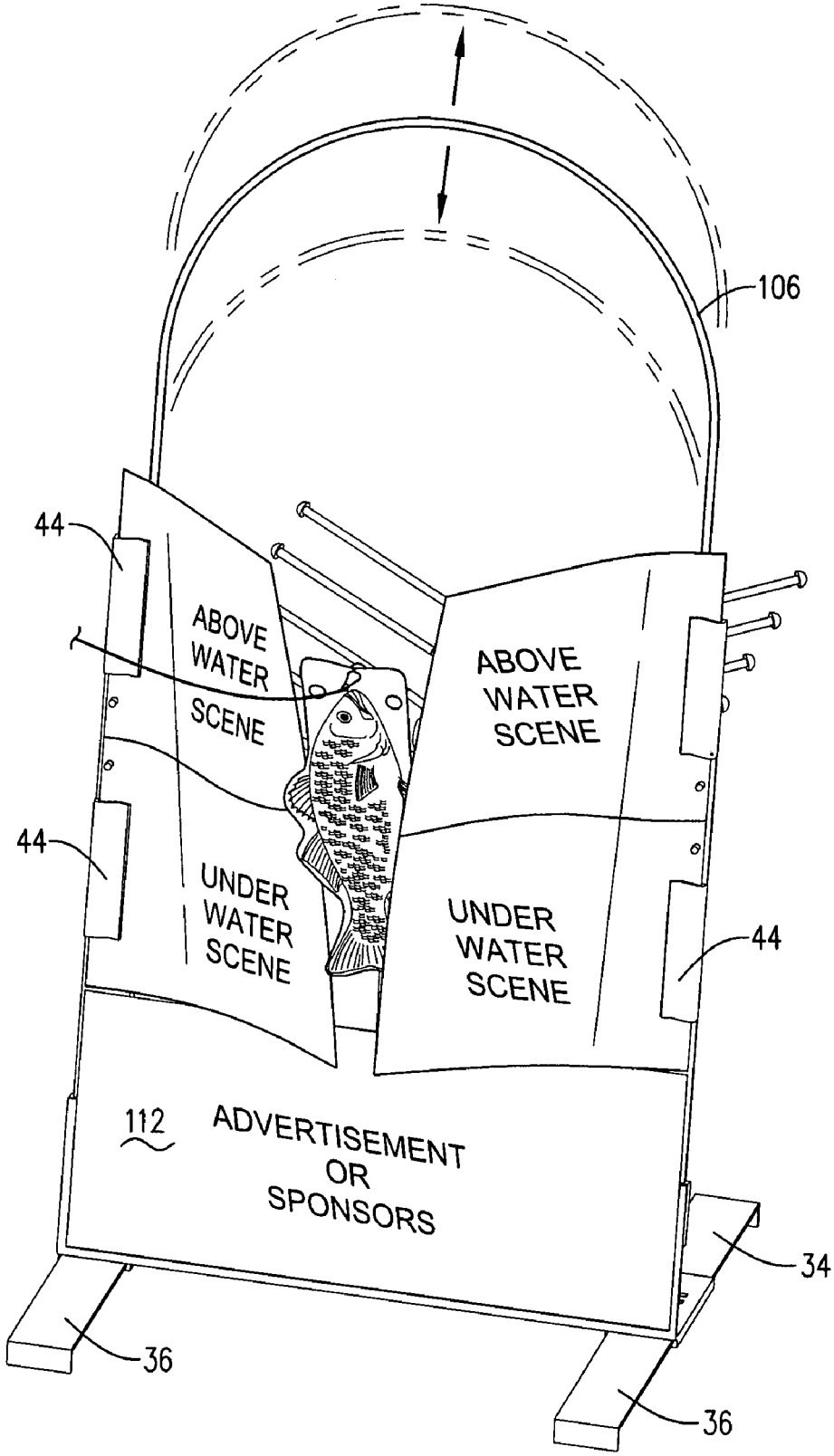
FIG. 9 is a front perspective view similar to FIG. 1 but showing the "catching" of a fish and the pulling of the fish through the doors.

The manner in which the fish 90 of the present invention are snared or caught will now be described in relation to FIGS. 6 and 9. The person playing this game, sport, will use any conventional rod and reel (not shown) using a conventional fishing line 122 of suitable strength and durability. For the purpose of the game the outer end of the line 122 will be provided with a "plug" 124 of special design for the purpose of the present invention. The plug 124 will be essentially conical in shape with an enlarged bulb 126 at the end thereof to provide suitable weight. The plug 124 is preferably made of resilient material such as rubber or plastic. The end of the plug 124 opposite from the bulb 126 connects with the line 122 and the shape of the plug permits reception thereof in the snare opening 100. For the purpose of catching a fish, such as game piece 90, the person playing the game or sport will cast the plug 124 into the opening between the loop 106 and the game board 20. It should be noted that the upper edges of the doors 42 and 44 are inclined toward the slot 50. At any event, when the person playing the game casts the plug 124 into the opening below the loop 106; the line 122 will pass downwardly through the slot 50 against one of the arms 70 and into the inclined opening 96 at the forward end of the fish 90. At this point the line will pass through the slot 98 into the snare opening 100. Pulling on the line 122 will cause the plug 124 to engage the snare opening 100 to pull a fish off the grommet 71.

Figure 10:
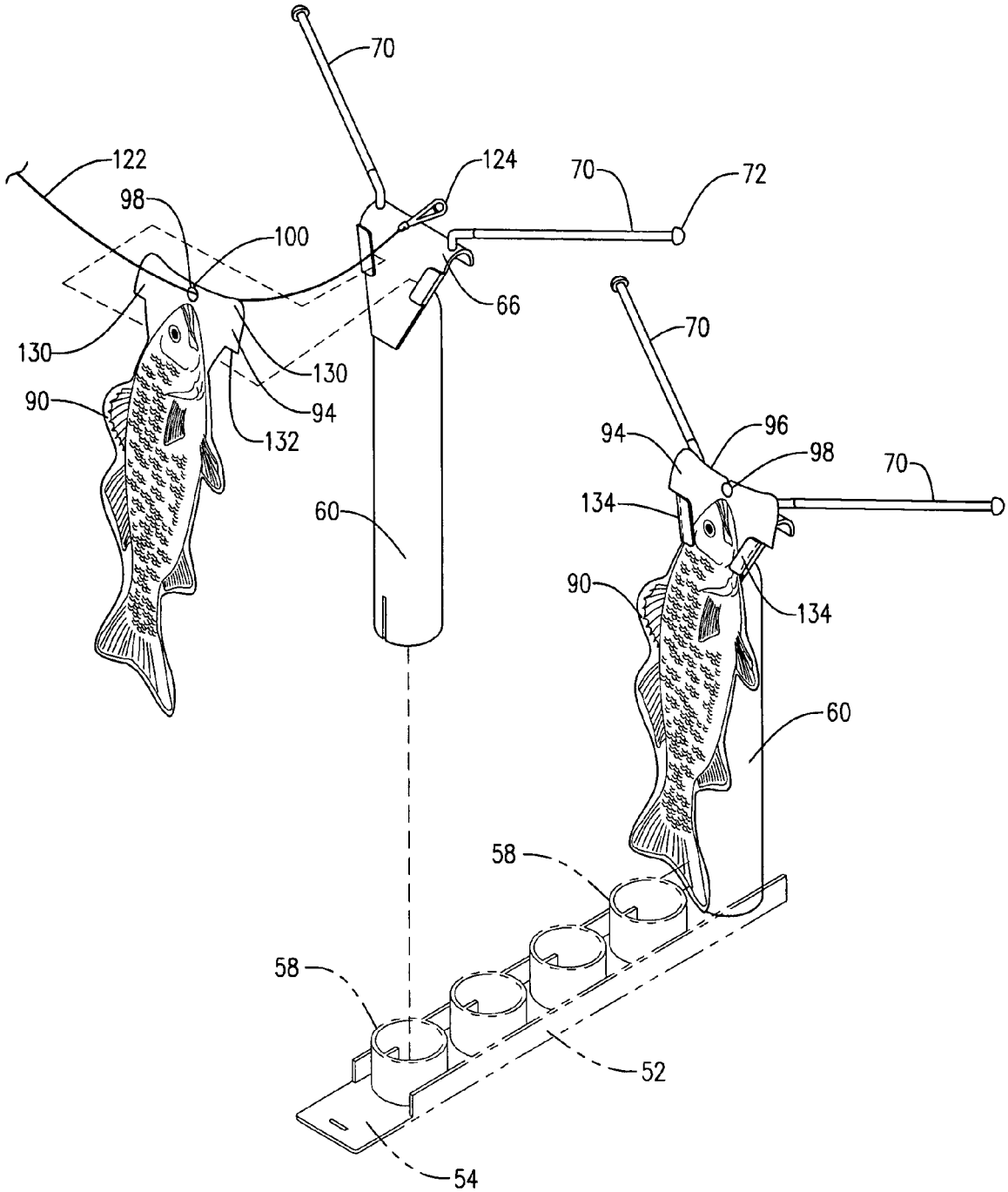
FIG. 10 is a view similar to FIG. 6 but showing an alternate embodiment of fish support.
Figure 11:
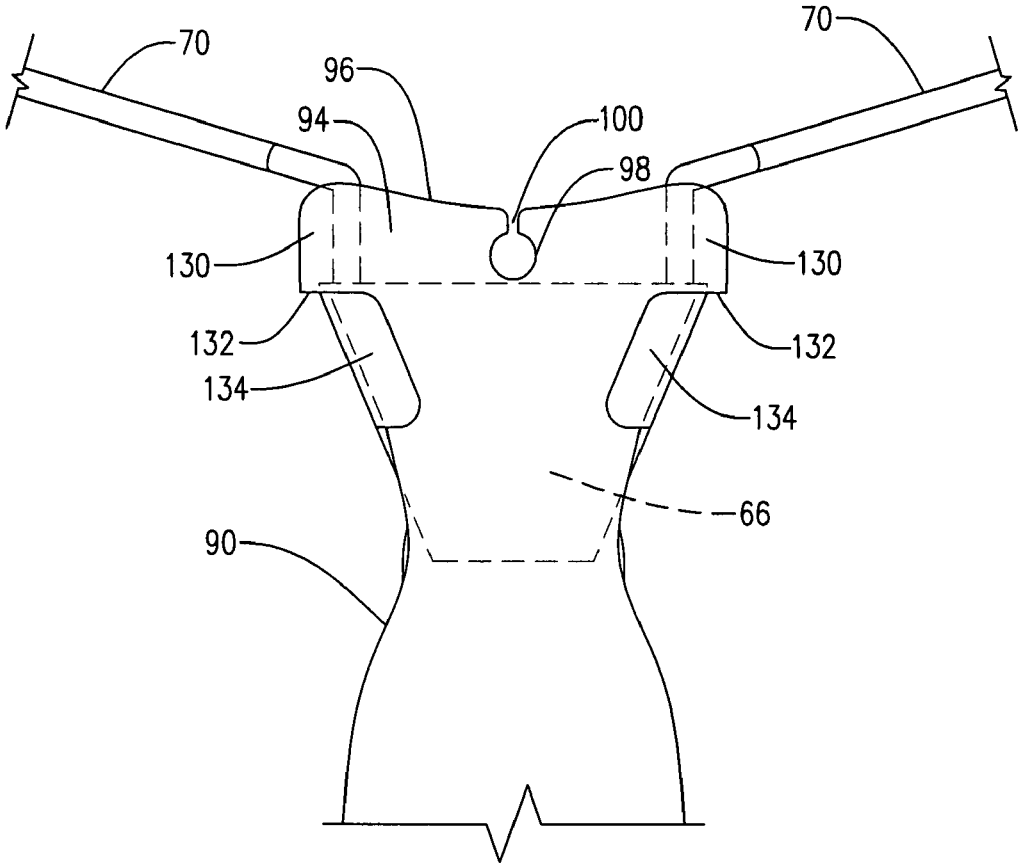
FIG. 11 is a detail, in elevation, of the fish and fish support shown in FIG. 10.

Turning now to FIG. 10, the game piece 90 (fish) still has the projecting portion 94 which includes the inclined entrance opening 96 which leads to a snare opening 98 (see now FIG. 11) through a slot 100. This compares with what has previously been shown in FIGS. 4 and 6. The support openings 102 have been eliminated and the corresponding grommets 71 are not employed. Instead, the projecting portion 94 is provided with a pair of opposite sideways projecting ears 130 below which are a pair of horizontal shoulders 132 which are adapted to rest against the upper ends of a pair of inclined clips or clamps 134. Clips 134 are secured to the sides of the triangular plate 66 and are disposed at an angle along the sides of the triangular plate 66 to provide a slot or slots for the fish 90 to be received therein. For this purpose the sides of the fish 90 below the shoulders 132 are shaped in a form of a diverging or converging slope 136.

Figure 12:
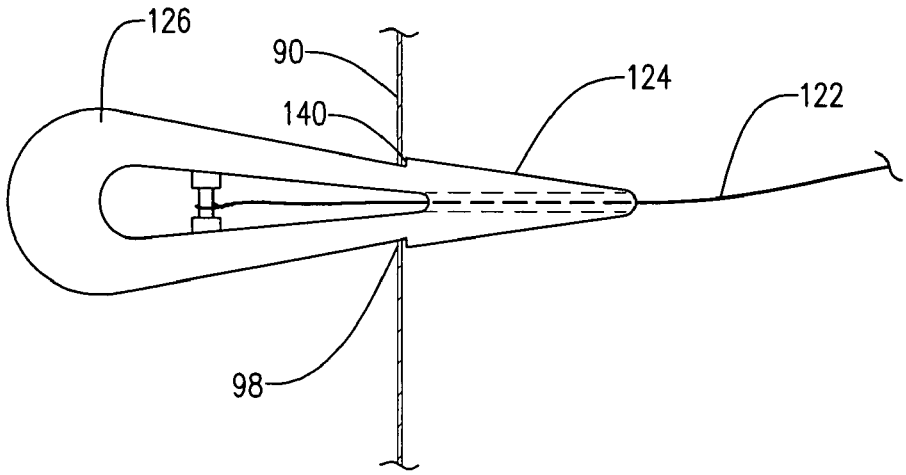
FIG. 12 is a view, partly in section, showing details of the plug that is used in snaring the fish.

FIG. 12 shows the plug 124 in slightly greater detail than previously disclosed. That is, when the line 122 passes through the slot 100 in the fish 90 and the line 122 is pulled so that the plug 124 enters the snare opening 98, the plug is also provided with a recess or shoulder 140 which prevents the plug from being disengaged from the fish 90.

Whereas the present invention has been described in particular relation to the drawings attached hereto, it should be understood that other and further modifications of the present invention, apart from those shown or suggested herein, may be made within the spirit and scope of this invention. No particular claim or significance should be attached to the materials employed in the various components of the invention. Purely for purposes of explanation and completeness, the fish 90 can be made from a thin plastic material such as 020" PVC/Vinyl sheet rock. Fish graphics can be applied to one or both sides of the fish by decal or screen printing. The plug 124 can be made by injection molding using a soft rubber or plastic material. The tubing 106 can be polyethylene tubing, for example. The game board 20 and base member 22 can be made of ABC plastic ⅛" thick. The tubes 60 and associated connections can be made from PVC plastic tubing. The "wallpaper" 116 and the coverings for the various doors can be made from graphics decal sheets. The doors themselves can be made from PVC plastic sheets @0.020" thickness with graphics decals attached.

What is claimed is:

1. A fishing apparatus comprising a flat, essentially vertical game board having an upper end and a lower end, a horizontal supporting plate having a forward end and a rear end, the forward end of the horizontal supporting plate being connected to the lower end of the game board, a fish support mounted behind the game board, one or more flat, relatively thin fish shaped members, each having the outline of a fish and each having an upper end forming an angled mouth and a lower end resembling the tail of a fish, each fish shaped member having a circular snare opening therein mounted directly below the mouth of the fish shaped member and a first slot leading from the mouth of the fish-shaped member to the circular snare opening, each fish shaped member being connected to the fish support by a releasable holding means, a casting line, a plug adapted to be connected to the end of the casting line so that the plug and line can be cast over the angled mouths of the fish shaped members, each plug being made of resilient material and being provided with a nose piece adjacent to the connection of the line to the plug, the nose piece tapering outwardly from a diameter of smaller size than the circular snare opening in the fish shaped member where the plug connects to the line to a diameter slightly larger than the diameter of the snare opening in the fish-shaped member, the plug being provided with a recess beyond the larger diameter of the nose piece so that, when the plug is pulled into the circular snare opening in the fish-shaped member, the nose piece will squeeze through the opening until the sides of the opening are received in the recess of the plug, so that pulling on the line after the plug has been received in the circular snare opening will cause the fish shaped member to pull against the releaseable holding means to release the fish-shaped member from the fish support, the game board having a second slot therein which is in alignment with the first vertical slot in the fish shaped member, the second vertical slot in the game board being associated with a pair of doors which are mounted on hinge axes for swinging movement when a fish-shaped member is pulled against the doors, the game board being tapered inwardly on opposite sides of the second slot so that a fisherman, if he gets his line over the upper end of the game board, can manipulate the line by sideways tugging into the second slot and thereafter into the first slot, and continued pulling on the fish-shaped member will cause the fish shaped member to be released from the fish support and to spring out through the hinged doors in a manner simulating the catching of fish in actual water.

2. A fishing apparatus as set forth in claim 1 wherein the game board is provided with a flexible and adjustable plastic loop located at the upper end of the game board to provide a space for the fisherman to cast the plug between the loop and the upper end of the game board.

3. A fishing apparatus as set forth in claim 1 wherein the fish support includes a horizontal tray extending to the rear of the horizontal support, a plurality of vertical tubes extending upwardly from the horizontal tray, each tube having an upper end to which is attached the releasable holding means.

4. A fishing apparatus as set forth in claim 1 wherein the releasable holding means includes at least one slot provided at the upper end of each tube, a grommet received in each slot, each fish shaped member being provided with a support opening adapted to receive a grommet therein.

5. A fishing apparatus as set forth in claim 1 wherein the releasable holding means includes a pair of spaced clips attached to the upper end of each tube and forming slots for receiving a fish-shaped member therein, each fish-shaped member having side portions adapted to be received in the slots provided by the clips.

* * * * *